US005685543A

United States Patent [19]

Garner

[11] Patent Number: 5,685,543

[45] Date of Patent: Nov. 11, 1997

[54] PLAYING CARD HOLDER AND DISPENSER

[76] Inventor: Lee B. Garner, R.R. 2, P.O. Box 289, Glyndon, Minn. 56547

[21] Appl. No.: 654,324

[22] Filed: May 28, 1996

[51] Int. Cl.[6] ..... A63F 1/12

[52] U.S. Cl. ..... 273/148 A; 273/149 R

[58] Field of Search ..... 273/149 R, 309, 273/148 A, 148 R; 312/50; 221/259, 276, 310

[56] References Cited

U.S. PATENT DOCUMENTS 4,457,512 7/1984 Stevenson ..... 273/149 R 5,382,024 1/1995 Blaha ..... 273/149 R

*Primary Examiner*—William M. Pierce

*Attorney, Agent, or Firm*—David A. Lingbeck

[57] ABSTRACT

A playing card holder and dispenser comprises a sleeve having a collar about the top end of the sleeve which is mounted to a playing card table with the collar resting on the top of the table and the rest of sleeve extending vertically beneath the top of the table and further comprises a card storage container having an over-sized top wall separated from a front wall to define an opening through which a playing card can be passed. A card support and pusher device is slidably disposed inside the container and comprises a card support member, a pair of elongate spring guides, a pair of springs, a spring support, and a pusher means stop member. A stack of playing cards are stacked on the card support member inside the storage container and are urged upward toward the top end of the storage container by the springs such that the top card is adjacent to and in alignment with an opening through which a user slides the top card.

9 Claims, 4 Drawing Sheets

PLAYING CARD HOLDER AND DISPENSER

BACKGROUND OF THE INVENTION

The present invention relates to a playing card holder and dispenser ideally for use with blackjack tables in casinos where the dealer places one or more decks of playing cards in the holder and dispenser, and as the game is played, the dealer slides playing cards one by one from the holder and dispenser to the players.

The prior art describes playing card dispensers which are primarily shoe-like devices in which the playing cards are stacked essentially side by side on a forwardly and downwardly sloped bottom wall. These playing card shoes are moveable upon the top of the table and take up some of the space on the table. They are usually easily knocked off the table because of the limited space afforded on the tables, which is taken up by not only the player's play area but also the tray storing the chips used to play the game.

One known prior art is a PLAYING CARD DISPENSER, U.S. Pat. NO. 4,750,743, issued on Jun. 14, 1988 and invented by Adolph E. Nicoletti, which comprises a shoe having a front wall to conceal the leading card, a slot sized to permit a playing card to pass through, a card pusher, and a contact roller for dispensing the cards.

Another known prior art is a CARD DISPENSING SHOE HAVING A COUNTING DEVICE AND METHOD OF USING THE SAME, U.S. Pat. NO. 5,374,061, issued on Dec. 20, 1994 and invented by Jim Albrecht, which comprises a means to hold a set of cards, means for sensing a mark on each card, means for incrementing the count for each card dealt, and means for displaying the count.

Also, another known prior art is a METHOD AND APPARATUS FOR SUPPLYING PLAYING CARDS AT RANDOM TO THE CASINO TABLE, U.S. Pat. NO. 5,199,710, issued on Apr. 6, 1993 and invented by Stewart Lamle, which comprises a printed and a card stock store which are mounted on the underside of the table.

Further, another known prior art is a PLAYING CARD SHUFFLER AND DISPENSER, U.S. Pat. NO. 5,382,024, issued on Jan. 17, 1995 and invented by Ernst Blaha, which comprises a housing, a storage container defining an output opening for singlely discharging a card, and a playing card shuffling container which is located adjacent the storage container.

None of the prior art describes a playing card holder and dispenser which is not positioned on the top of the table and is out of the way of the players and even the dealer and yet allows the dealer to deal the playing cards one-by-one to the players. There is definitely a need for such a device.

SUMMARY OF THE INVENTION

This invention relates to a playing card holder and dispenser which comprises a substantially rectangular sleeve having a collar which is tapered downwardly and forwardly from the back to the front thereof and which is attached about the top end thereof, and a substantially rectangular card storage container having at least a partially open back through which the cards are stacked in the container upon a card support and pusher means which is slidably mounted inside the storage container and is retractably biased upward toward the top end of the storage container which is closed by a top wall having a finger slot therethrough, the top wall being separated from the front wall thus defining an opening sized to allow one playing card to pass therethrough at a time. The sleeve is angularly mounted to the table with the collar resting upon and fastened to the surface of the top of the table and with the rest of the sleeve extending downwardly below the surface of the table. The card storage container slidably extends in the sleeve with the perimeter portion of the top wall resting upon the collar of the sleeve and with the top wall being angled downwardly forward relative to the surface of the table. The playing cards are stacked upon the card support and pusher means in the storage container and are urged upward such that the top playing card is positioned adjacent to and in alignment with the opening. Typically, the dealer puts the tip of his/her middle finger on the top card through the finger slot in the top wall and slides that playing card through the opening defined by the top wall and the front wall to a player at the table.

One objective of the present invention is to provide a playing card holder and dispenser which eliminates the playing card dispensing shoes which are commonly used on such tables.

Another objective of the present invention is to provide a playing card holder and dispenser which opens up more space on the table since the storage container containing the playing cards is located essentially below the surface of the table rather than on top of the table as with the prior art.

Also, another objective of the present invention is to provide a playing card holder and dispenser which essentially prevents the bending of the playing cards as they are dispensed from the device, which is a problem with the playing card dispensing shoes.

Yet, another objective of the present invention is to provide a playing card holder and dispenser which won't jam up the playing cards against the top wall which is a problem with the card dispensing shoes jamming up the cards against the front wall.

Further objectives and advantages of the present invention will become apparent as the description proceeds and when taken in conjunction with the accompanying drawings wherein:

DETAILED DESCRIPTION OF THE INVENTION

Figure 1:
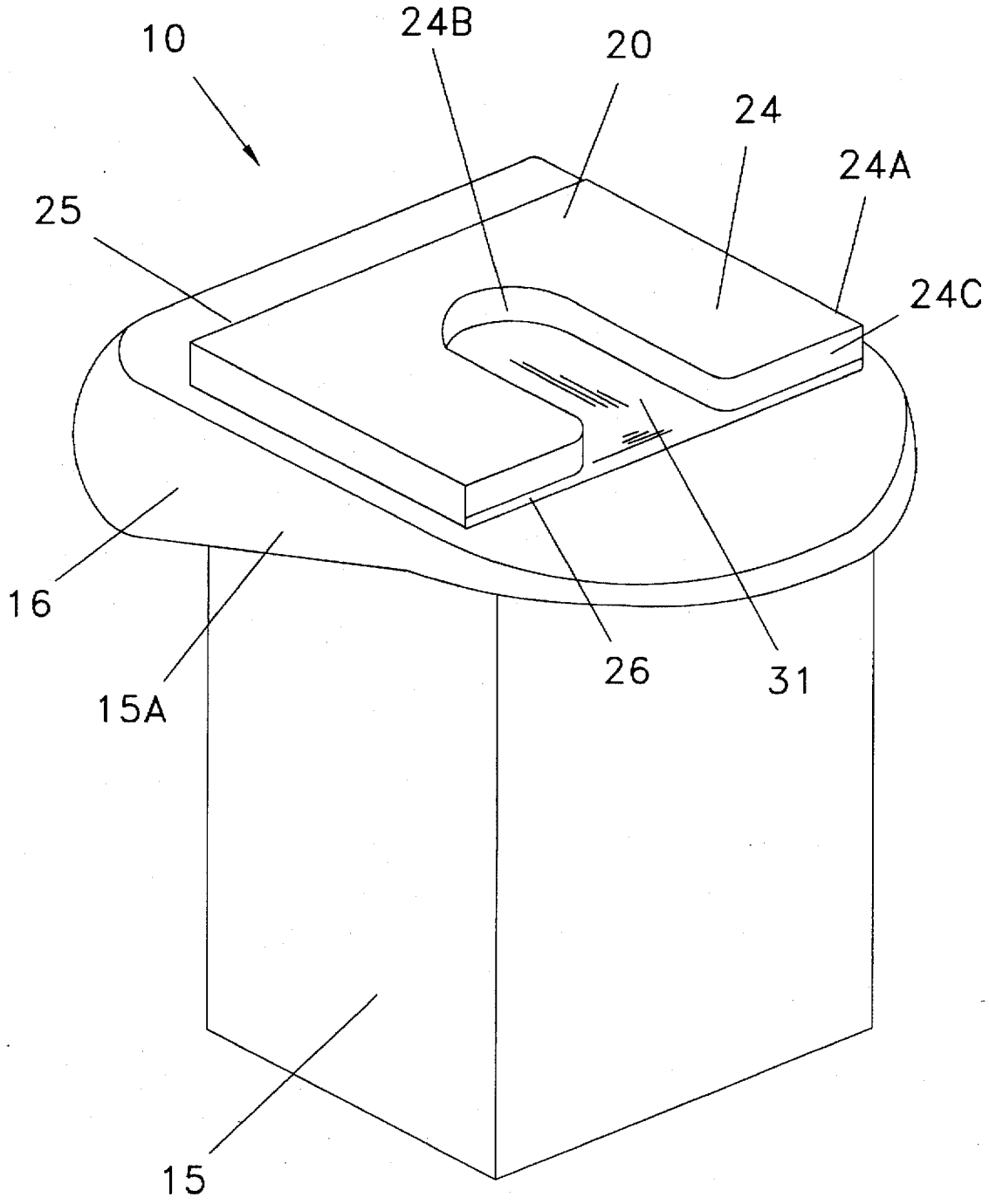
FIG. 1 is a top perspective view of the playing card holder and dispenser with the card storage container in the sleeve.
Figure 2:
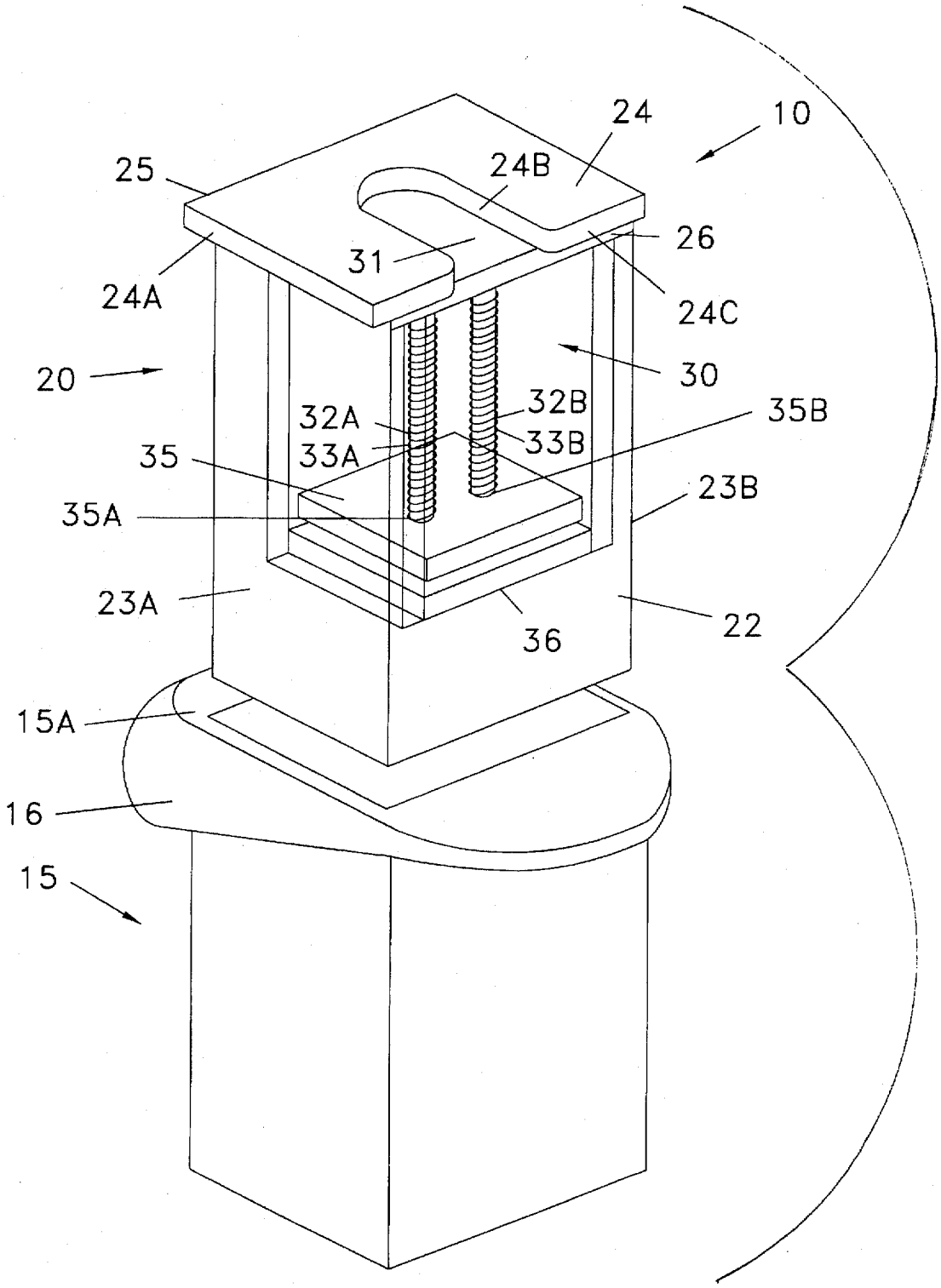
FIG. 2 is an exploded perspective view of the playing card holder and dispenser with card storage container removed from the sleeve.

Referring to the drawings in FIGS. 1–4, in particular, the playing card holder and dispenser 10 comprises a substantially rectangular sleeve 15 having a top end 15*a* and a collar 16 attached about the top end 15*a* of the sleeve 16 and being tapered downwardly and forwardly from the back to the front thereof and an elongate, rectangular playing card storage container 20 having a partially open back 21 through which a stack of playing cards can be passed, a front wall 22, two side walls 23*a* & 23*b*, and an oversized top wall 24 which has a perimeter portion 24*a* which extends perpendicularly outside of the back 21, front 22 and side walls 23*a*

Figure 3:
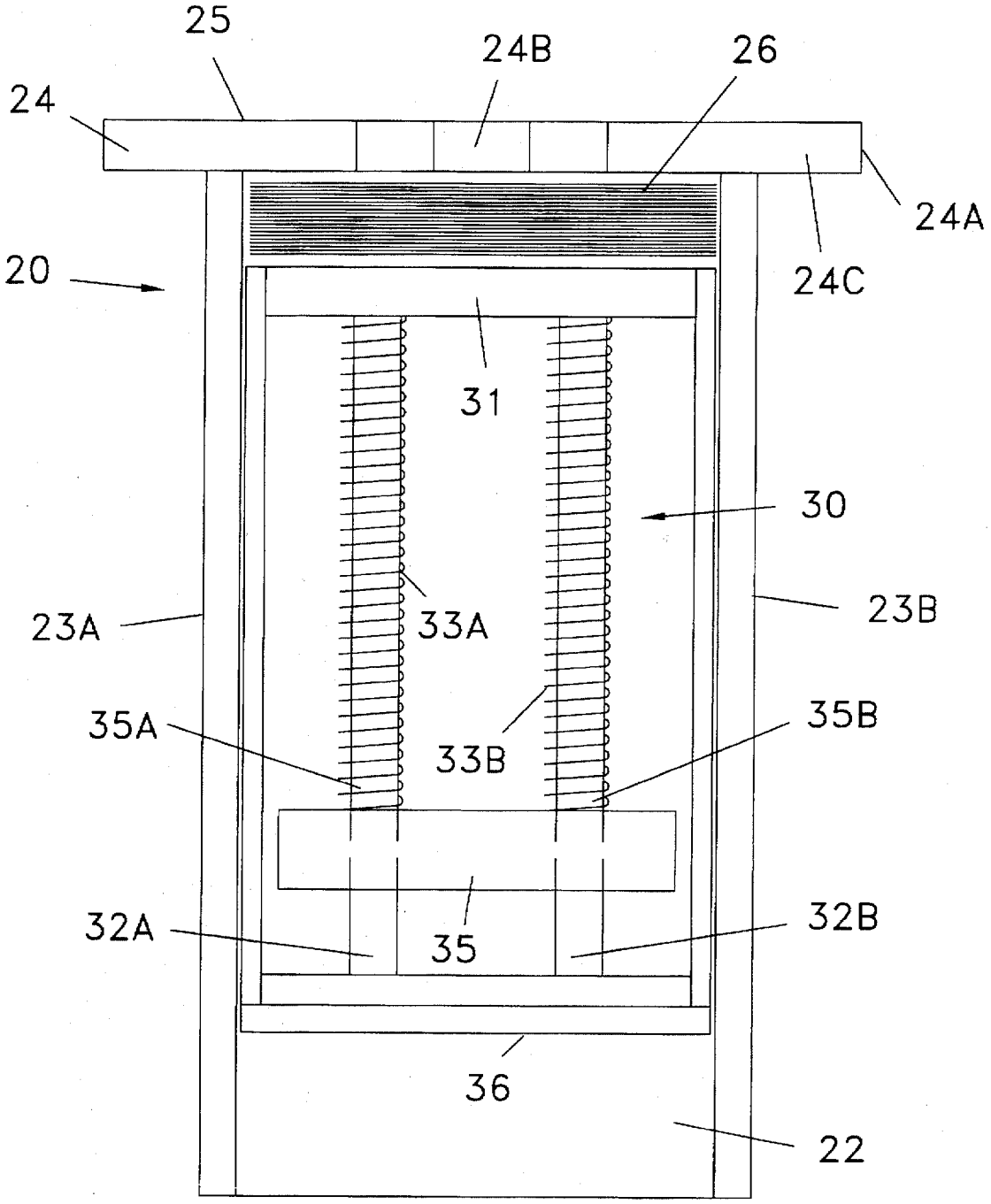
FIG. 3 is a detailed front side view of the card storage container showing, in particular, the card support and pusher means.

& 23*b* and further has a finger slot 24*b* extending through a central portion of the front end 24*c* of the top wall 24 and is separated from the front wall 22 thus defining an opening 26 sized to allow a playing card to pass therethrough. The playing card holder and dispenser 10 also comprises a card support and pusher means 30 which comprises a planar card support member 31 upon which the playing cards are placed inside the storage container 20, the card support member 31 being retractably biased upward toward the top end 25 of the storage container 20 and being essentially a moveable shelf. As shown in FIG. 3, the card support and pusher means 30 also comprises a pair of elongate spring guides 32*a* & 32*b* each of which has an end fixedly attached to the underside of the card support member 31 or shelf, the elongate spring guides 32*a* & 32*b* essentially being a pair of rods disposed parallel to each other and to the longitudinal axis of the storage container 20. A pair of springs 33*a* & 33*b* are mounted about the spring guides 32*a* & 32*b* for urging the card support member 31 upward. The springs 33*a* & 33*b* are mounted upon a planar spring support 35 which is essentially a wall disposed perpendicular to the front 22 and back sides 21 and being centrally disposed relative to the top and bottom of the storage container 20 with ends of the wall being fastened with screws as such to the front 22 and back sides 21. The spring support 35 further has a pair of holes 35*a* & 35*b* through which the spring guides 32*a* & 32*b* reciprocally extend. The holes 35*a* & 35*b* are smaller than the diameters of the springs 33*a* & 33*b* to prevent the springs 33*a* & 33*b* from passing through the holes 35*a* & 35*b*. A pusher means stop member 36 is fixedly attached to the ends of the spring guides 32*a* & 32*b* opposite the ends to which the card support member 31 is attached. The pusher means stop member 36 is slidably disposed between the spring support 35 and the bottom of the storage container 20, and comes into contact with and is stopped by the spring support 35 as it is retractably urged upward by the springs 33*a* & 33*b*. The pusher means stop member 36 prevents the last playing card which is now the top playing card from binding with underside of the top wall 24 and also positions the last and top playing card in alignment with the opening 26.

Figure 4:
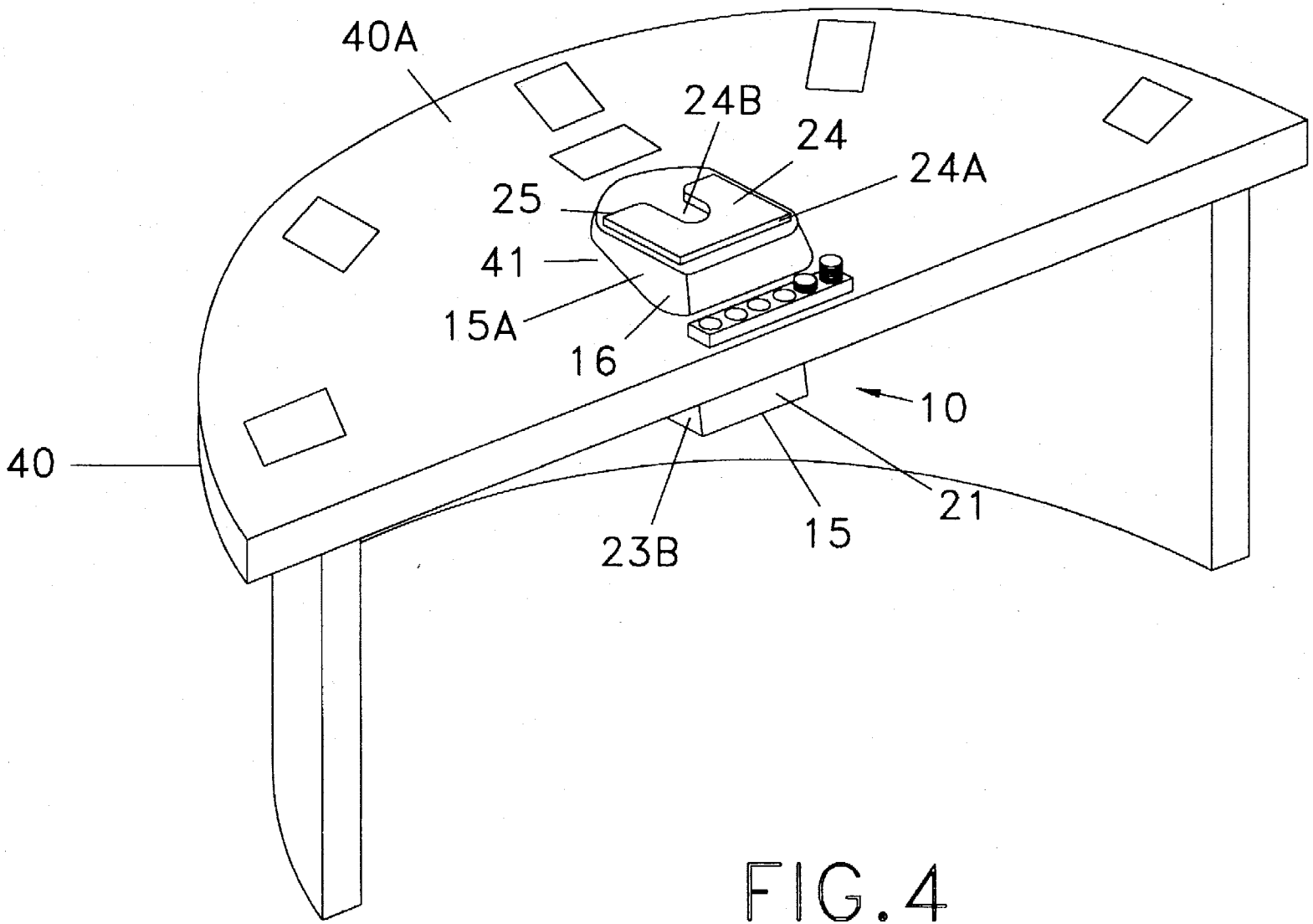
FIG. 4 is a perspective view of a partial playing card table with the playing card holder and dispenser operably mounted to the table.

As shown in FIG. 4, to install the playing card holder and dispenser 10, preferably a substantially rectangular hole 41 having a perimeter relatively smaller than the perimeter of the collar 16 about the sleeve 15 but being large enough to receive the sleeve 15 itself, is made in the top 40*a* of the table 40. The sleeve 15 is mounted to the table 40 with the sleeve 15 being extended angularly through the hole 41*a* with the underside of the collar 16 resting upon the table 40 and the collar 16 being fastened with fasteners to the top 40*a* of the table 40. The sleeve 16 essentially functions as a support and stabilizer for the card storage container 20 which removeably extends through the top end 15*a* of and into the sleeve 15 with the underside of the perimeter portion 24 of the top wall 24 resting upon the collar 16 of the sleeve 15 and with the top wall 24 being disposed at an angle relative to the surface 40*a* of the table 40 such that the top wall 24 is generally slanted downwardly forward relative to the top 40*a* of the table 40. The top card can be easily removed from the storage container 20 by the dealer or user extending the tip of his/her finger through the finger slot 24*b* in the top wall 24 and engaging the top card and sliding the top card forward through the opening 26. Every top card is always moved into a position adjacent to and in alignment with the opening 26 so the dealer can easily and conveniently slide each top card through the opening 26 without the playing card being jammed in the storage container 20. Once all the playing cards having played from the storage container 20, the dealer or user simply lifts the storage container 20 vertically out of the sleeve 15 and after reshuffling the stack of playing cards, the dealer urges the card support and pusher means 30 downward with his/her hand and places the stack of playing cards through the open back 21 and onto the card support member 31 and then releases the card support and pusher means 30 which urges the stack of cards upward toward the top end 25 of the storage container 20 with the top card being positioned adjacent to and in alignment with the opening 26. The dealer then replaces the storage container 20 in the sleeve 15 and is ready to begin dealing the playing cards from the storage container 20 one-by-one.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A playing card holder and dispenser comprising:

a sleeve having a top end and being adapted to be mounted to a table;

an elongate card storage container being removeably received in said sleeve and having a top end, a front and side walls, an oversized top wall, and an opening dimensioned to allow one playing card at a time to be dispensed therethrough; and a card support means and pusher means slidably mounted inside said storage container for respectively supporting playing cards and urging the playing cards toward said top end of said storage container.

2. A playing card holder and dispenser as described in claim 1, wherein said sleeve further comprises a collar about said top end, said sleeve being generally suspended from a top of said table.

3. A playing card holder and dispenser as described in claim 2, wherein said sleeve angularly extends through said top of said table with said collar being mounted upon said top of said table.

4. A playing card holder and dispenser as described in claim 3, wherein said oversized top wall has a perimeter portion which extends outward beyond said front and side walls of said card storage container and which rests upon said collar of said sleeve when said card storage container is removeably received in said sleeve.

5. A playing card holder and dispenser as described in claim 4, wherein said oversized top wall further has a slot through which a user engages and slides said playing card from said storage container through said opening, said slot extending through a front end of said oversized top wall.

6. A playing card holder and dispenser as described in claim 1, wherein said card support and pusher means comprises a card support member upon which stacks of playing cards can be positioned inside said card storage container and a means for retractably biasing said card support member toward said top end of said card storage container.

7. A playing card holder and dispenser as described in claim 6, wherein said means for retractably biasing said card support member comprises at least one spring guide attached to said card support member, at least one spring mounted about said at least one spring guide and positioned against said card support member, and a spring support upon said at least one spring is mounted.

8. A playing card holder and dispenser as described in claim 7, wherein said spring support has at least one hole through which said at least one spring guide slides, said spring support being fixedly attached to said card storage container.

9. A playing card holder and dispenser as described in claim 7, wherein said card support and pusher means further comprises a pusher means stop member attached to said at least one spring guide and contactable with said spring support to limit upward biased movement of said card support member.

* * * * *